US012606892B2

(12) United States Patent
Kim et al.

(10) Patent No.: US 12,606,892 B2
(45) Date of Patent: Apr. 21, 2026

(54) MEMBER FOR AUTOMOBILE STRUCTURE

(71) Applicant: Hyundai Steel Company, Incheon (KR)

(72) Inventors: Hye Jin Kim, Incheon (KR); Kyu Yeon Hwang, Incheon (KR); Jin Ho Lee, Incheon (KR); Hyun Yeong Jung, Incheon (KR); Seung Pill Jung, Incheon (KR)

(73) Assignee: Hyundai Steel Company, Incheon (KR)

( * ) Notice: Subject to any disclaimer, the term of this patent is extended or adjusted under 35 U.S.C. 154(b) by 673 days.

(21) Appl. No.: 18/077,040

(22) Filed: Dec. 7, 2022

(65) Prior Publication Data

US 2023/0128371 A1 Apr. 27, 2023

Related U.S. Application Data

(63) Continuation of application No. PCT/KR2021/019410, filed on Dec. 20, 2021.

(30) Foreign Application Priority Data

Dec. 23, 2020 (KR) ..... 10-2020-0182433

(51) Int. Cl.

| | |
|---|---|
| ***C22C 38/02*** | (2006.01) |
| ***C22C 38/00*** | (2006.01) |
| ***C22C 38/04*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C23C 2/12*** | (2006.01) |
| ***C23C 2/28*** | (2006.01) |
| ***C23C 2/40*** | (2006.01) |

(52) U.S. Cl.

CPC ..... *C22C 38/28* (2013.01); *C22C 38/002* (2013.01); *C22C 38/02* (2013.01); *C22C 38/04* (2013.01); *C22C 38/24* (2013.01); *C22C 38/26* (2013.01); *C22C 38/32* (2013.01); *C23C 2/12* (2013.01); *C23C 2/29* (2022.08); *C23C 2/40* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 8,840,834 | B2 | 9/2014 | Matsuda et al. | |
| 10,286,439 | B2 | 5/2019 | Jin et al. | |
| 10,870,902 | B2 | 12/2020 | Ono et al. | |
| 11,208,702 | B2 | 12/2021 | Sakakibara et al. | |
| 2011/0048589 | A1 | 3/2011 | Matsuda et al. | |
| 2015/0007911 | A1* | 1/2015 | Murakami | C22C 38/32 148/507 |
| 2021/0332454 | A1 | 10/2021 | Ono et al. | |

FOREIGN PATENT DOCUMENTS

| | | | |
|---|---|---|---|
| JP | 2006-212663 | A | 8/2006 |
| JP | 6132017 | B2 | 5/2017 |
| JP | 6680421 | B1 | 4/2020 |
| KR | 2010-0116608 | A | 11/2010 |
| KR | 2016-0078839 | A | 7/2016 |
| KR | 2017-0118926 | A | 10/2017 |
| KR | 2018-0095757 | A | 8/2018 |
| KR | 2018-0130118 | A | 12/2018 |
| KR | 2020-0062926 | A | 6/2020 |

OTHER PUBLICATIONS

Extended European Search Report issued Mar. 25, 2025 in corresponding European Patent Application No. 21911436.0.

* cited by examiner

*Primary Examiner* — Jophy S. Koshy
(74) *Attorney, Agent, or Firm* — Fox Rothschild LLP

(57) ABSTRACT

One embodiment of the present invention discloses a member for automobile structure including a base steel sheet and a plating layer covering at least one surface of the base steel sheet, wherein the member for automobile structure has a tensile strength of 1350 MPa or greater and a yield strength of 900 MPa or greater, wherein the base steel sheet includes a martensite phase having an area fraction of 80% or greater, an iron-based carbide located inside the martensite phase and having an area fraction of less than 5% based on the martensite phase, and precipitates distributed inside the base steel sheet, wherein a mismatch dislocation exists at the interface between iron and the precipitates of the base steel sheet, and a difference between lattice constants of the iron and the precipitates is less than 25% of the lattice constants of the iron.

9 Claims, 11 Drawing Sheets

MEMBER FOR AUTOMOBILE STRUCTURE

CROSS-REFERENCES TO RELATED APPLICATIONS

This Application is a continuation application of PCT/KR2021/019410 filed Dec. 20, 2021, which claims priority of Korean Patent Application 10-2020-0182433 filed on Dec. 23, 2020. The entire contents of these applications are incorporated herein by reference in their entirety.

TECHNICAL FIELD

Embodiments of the present invention relate to a member for an automobile structure.

BACKGROUND

As environmental regulations and fuel economy regulations are strengthend around the world, the need for lighter vehicle materials is increasing. Accordingly, research and development on ultra-high-strength steel and hot stamping steel are being actively conducted. Among them, the hot stamping process consists of heating/forming/cooling/trimming, and uses the phase transformation of the material and the change of the microstructure during the process.

Recently, studies to improve delayed fracture, corrosion resistance, and weldability occurring in a hot stamping member manufactured by a hot stamping process have been actively conducted. As a related technology, there is Korean Application Publication No. 10-2018-0095757 (Title of the invention: Method of manufacturing hot stamping member).

SUMMARY

Technical Problem

Embodiments of the present invention provide a member for an automobile structure that prevents or minimizes delayed fracture due to residual hydrogen.

Technical Solution

In an exemplary embodiment the present invention discloses a member for automobile structure including a base steel sheet and a plating layer covering at least one surface of the base steel sheet. The member for automobile structure has a tensile strength of 1350 MPa or greater and a yield strength of 900 MPa or greater, the base steel sheet includes a martensite phase having an area fraction of 80% or greater, an iron-based carbide located inside the martensite phase and having an area fraction of less than 5% based on the martensite phase, and precipitates distributed inside the base steel sheet, and a mismatch dislocation exists at interface between iron and the precipitates of the base steel sheet, and a difference between lattice constants of the iron and the precipitates is less than 25% of the lattice constants of the iron.

In an exemplary embodiment, the iron-based carbide may be acicular with a diameter of less than 0.2 μm and a length of less than 10 In an exemplary embodiment, the martensite includes a lath phase, and among the iron-based carbides, an area fraction of iron-based carbides horizontal to a longitudinal direction of the lath phase is greater than an area fraction of iron-based carbides perpendicular to the longitudinal direction of the lath phase.

In an exemplary embodiment, the martensite includes a lath phase, and among the iron-5 based carbides, an area fraction of the iron-based carbides forming an angle of 20° or less with a longitudinal direction of the lath phase is 50% or greater.

In an exemplary embodiment, the martensite includes a lath phase, and among the iron-based carbides, an area fraction of iron-based carbides forming an angle of 70° or greater and 90° or less with a longitudinal direction of the lath phase is less than 50%.

In an exemplary embodiment, the interface between the precipitates and the iron has a relationship of:

$$(001)_{Fe} \| (001)_{precipitate} \text{ and } [100]_{precipitate} \| [110]_{Fe}$$

In an exemplary embodiment, the precipitates include at least one carbide of titanium (Ti), niobium (Nb), and vanadium (V), and traps hydrogen.

In an exemplary embodiment, among the carbides, TiC has a size of 6.8 nm or greater, NbC has a size of 16.9 nm or greater, and VC has a size of 4.1 nm or greater.

In an exemplary embodiment, the titanium (Ti), the niobium (Nb) and the vanadium (V) are included within the range of the solubility for the iron.

In an exemplary embodiment, the base steel sheet includes an amount of 0.19 wt % to 0.38 wt % of carbon (C), an amount of 0.5 wt % to 2.0 wt % of manganese (Mn), an amount of 0.001 wt % to 0.005 wt % of boron (B), an amount of 0.03 wt % or less of phosphorus (P), an amount of 0.003 wt % or less of sulfur (S), an amount of 0.1 wt % to 0.6 wt % of silicon (Si), an amount of 0.1 wt % to 0.6 wt % of chromium (Cr), the balance of iron (Fe), and unavoidable impurities, based on the total weight of the base steel sheet.

In an exemplary embodiment, the plating layer includes aluminum (Al).

Advantageous Effects

According to exemplary embodiments of the present invention, by including a precipitate forming a semi-coherent interface with iron of the base steel sheet in the base steel sheet, residual hydrogen in the base steel sheet is reduced, and delayed fracture of the member for an automobile structure due to the residual hydrogen can be prevented.

DETAILED DESCRIPTION

Figure 1:
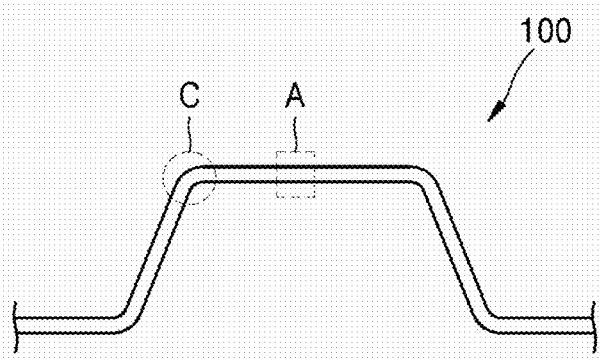
FIG. 1 shows a cross-sectional view schematically illustrating a portion of a member for an automobile structure according to an exemplary embodiment of the present invention.

Because the present invention may apply various transformations and may have various embodiments, specific embodiments are illustrated in the drawings and described in detail in the detailed description. Effects and features of the present invention, and a method for achieving them, will become apparent with reference to the embodiments described below in detail in conjunction with the drawings. However, the present invention is not limited to the embodiments disclosed below and may be implemented in various forms.

In the following embodiments, terms such as first, second, etc. are used for the purpose of distinguishing one component from another without limiting meaning.

In the following embodiments, the singular expression includes the plural expression unless the context clearly dictates otherwise.

In the following embodiments, the terms 'include' or 'have' means that the features or elements described in the specification are present, and do not preclude the possibility that one or more other features or elements will be added.

In the following embodiments, when a portion of a film, region, component, etc. is said to be on or on another portion, it includes not only the case where it is directly on top of another portion, but also the case where another film, region, component, etc. is interposed therebetween.

In the drawings, the size of the components may be exaggerated or reduced for convenience of description. For example, because the size and thickness of each component shown in the drawings are arbitrarily indicated for convenience of description, the present invention is not necessarily limited to the illustrated one.

In cases where certain embodiments are otherwise practicable, a specific process sequence may be performed different from the described sequence. For example, the two processes described in succession may be performed substantially simultaneously, or may be performed in an order opposite to the described order.

Hereinafter, embodiments of the present invention will be described in detail with reference to the accompanying drawings, and when describing with reference to the drawings, the same or corresponding components will be assigned the same reference numerals.

Figure 2:
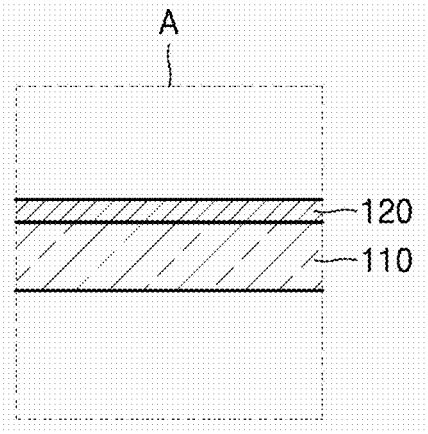
FIG. 2 shows a cross-sectional view schematically illustrating a portion A of FIG. 1.
Figure 3:
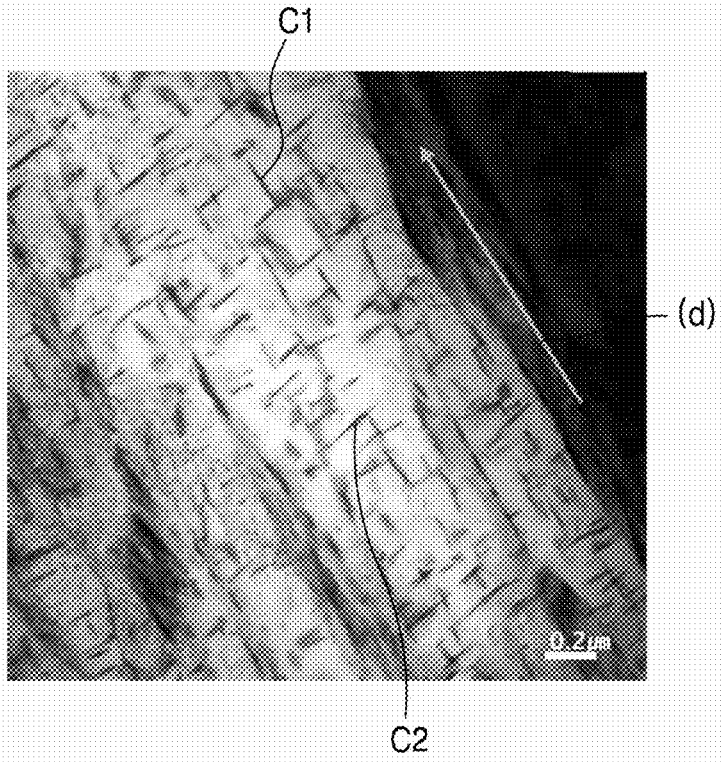
FIG. 3 shows a plan view illustrating a portion of the base steel sheet of FIG. 2.

FIG. 1 shows a cross-sectional view schematically illustrating a portion of a member for an automobile structure according to an exemplary embodiment of the present invention, FIG. 2 is a cross-sectional view schematically illustrating a portion A of FIG. 1, and FIG. 3 is a plan view illustrating a portion of the base steel sheet of FIG. 2.

Referring to FIGS. 1 to 3, a member 100 for an automobile structure according to an exemplary embodiment of the present invention may include at least one bent portion (C), and may have a tensile strength of 1350 MPa or greater and a yield strength of 900 MPa or greater.

The member 100 for an automobile structure may include a base steel sheet 110 and a plating layer 120 covering at least one surface of the base steel sheet 110.

The base steel sheet 110 may be a steel sheet manufactured by performing a hot rolling process and/or a cold rolling process on a slab cast to include a predetermined alloying element in a predetermined content. Such the base steel sheet 110 may exist as a full austenite structure at a hot stamping heating temperature, and then may be transformed into a martensitic structure upon cooling.

The average size of the initial austenite grains of the base steel sheet 110 may be 10 μm to 45 μm. Therefore, the area of the grain boundary, which is a nucleation site of recrystallized grains, is increased, thereby promoting dynamic recrystallization behavior. In addition, the base steel sheet 110 includes a component system that may have a microstructure including a martensite phase of 80% or greater by area fraction. In addition, the base steel sheet 110 may include a bainite phase in an area fraction of less than 20%.

For example, the base steel sheet 110 may include carbon (C), manganese (Mn), boron (B), phosphorus (P), sulfur (S), silicon (Si), chromium (Cr), the balance of iron (Fe), and other unavoidable impurities. In addition, the base steel sheet 110 may further include at least one alloying element of titanium (Ti), niobium (Nb), and vanadium (V) as an additive. In addition, the base steel sheet 110 may further include a predetermined amount of calcium (Ca).

Carbon (C) functions as an austenite stabilizing element in the base steel sheet 110. Carbon is a main element that determines the strength and hardness of the base steel sheet 110, and is added for the purpose of securing the tensile strength (e.g., tensile strength of 1,350 MPa or greater) of the base steel sheet 110 and ensuring hardenability, after the hot stamping process. Such carbon may be included in an amount of 0.19 wt % to 0.38 wt % based on the total weight of the base steel sheet 110. When the carbon content is less than 0.19 wt %, it is difficult to secure a hard phase (martensite, etc.), so it is difficult to satisfy the mechanical strength of the base steel sheet 110. Conversely, when the content of carbon exceeds 0.38 wt %, a problem of brittleness or bending performance reduction of the base steel sheet 110 may be caused.

Manganese (Mn) fundtions as an austenite stabilizing element in the base steel sheet 110. Manganese is added to increase hardenability and strength during heat treatment. Such manganese may be included in an amount of 0.5 wt % to 2.0 wt % based on the total weight of the base steel sheet 110. When the manganese content is less than 0.5 wt %, the hardenability effect is not sufficient, and the hard phase fraction in the molded article after hot stamping may be insufficient due to insufficient hardenability. On the other hand, when the content of manganese exceeds 2.0 wt %, ductility and toughness due to manganese segregation or pearlite bands may be reduced, which may cause deterioration in bending performance and may generate a heterogeneous microstructure.

Boron (B) is added for the purpose of securing the hardenability and strength of the base steel sheet 110 by suppressing the transformation of ferrite, pearlite, and bainite to secure a martensitic structure. In addition, boron segregates at grain boundaries to increase hardenability by lowering grain boundary energy, and has a grain refinement effect by increasing austenite grain growth temperature. Such boron may be included in an amount of 0.001 wt % to 0.005 wt % based on the total weight of the base steel sheet 110. When boron is included in the above range, it is possible to prevent the occurrence of brittleness at the hard phase grain boundary, and secure high toughness and bendability. When the content of boron is less than 0.001 wt %, the hardenability effect is insufficient, and on the contrary, when the content of boron exceeds 0.005 wt %, the solubility is low, and depending on the heat treatment conditions, it is easily precipitated at the grain boundary, which may deteriorate hardenability or cause high-temperature embrittlement, and toughness and bendability may be reduced due to the occurrence of hard phase grain boundary embrittlement.

Phosphorus (P) may be included in an amount greater than 0 wt % and 0.03 wt % or less based on the total weight of the base steel sheet 110 in order to prevent deterioration of the toughness of the base steel sheet 110. When the phosphorus content exceeds 0.03 wt %, the iron phosphide compound is formed to deteriorate toughness and weldability, and cracks may be induced in the base steel sheet 110 during the manufacturing process.

Sulfur (S) may be included in greater than 0 wt % and 0.003 wt % or less based on the total weight of the base steel sheet 110. When the sulfur content exceeds 0.003 wt %, hot workability, weldability, and impact properties are deteriorated, and surface defects such as cracks may occur due to the formation of large inclusions.

Silicon (Si) functions as a ferrite stabilizing element in the base steel sheet 110. Silicon improves the strength of the base steel sheet 110 as a solid-solution strengthening element, and improves the carbon concentration in austenite by suppressing the formation of carbides in the low-temperature region. In addition, silicon is a key element in hot-rolling, cold-rolling, hot-pressing, homogenizing the structure (perlite, manganese segregation zone control), and fine dispersion of ferrite. Silicon serves as a martensitic strength heterogeneity control element to improve collision performance. Such silicon may be included in an amount of 0.1 wt % to 0.6 wt % based on the total weight of the base steel sheet 110. When the content of silicon is less than 0.1 wt %, it is difficult to obtain the above-described effect, and cementite formation and coarsening may occur in the final hot stamping martensite structure. Conversely, when the content of silicon exceeds 0.6 wt %, hot-rolling and cold-rolling loads may increase, and plating properties of the base steel sheet 110 may be deteriorated.

Chromium (Cr) is added for the purpose of improving the hardenability and strength of the base steel sheet 110. Chromium makes it possible to refine grains and secure strength through precipitation hardening. Such chromium may be included in an amount of 0.1 wt % to 0.6 wt % based on the total weight of the base steel sheet 110. When the content of chromium is less than 0.1 wt %, the precipitation hardening effect is low, and on the contrary, when the content of chromium exceeds 0.6 wt %, the Cr-based precipitates and matrix solid-solution capacity increase to decrease toughness, and production cost may increase due to cost increase.

On the other hand, other unavoidable impurities may include nitrogen (N) and the like.

When a large amount of nitrogen (N) is added, the amount of solid-dissolved nitrogen may increase, thereby reducing impact properties and elongation of the base steel sheet 110. Nitrogen may be included in an amount of greater than 0% and 0.001% by weight or less based on the total weight of the base steel sheet 110. When the nitrogen content exceeds 0.001 wt %, the impact properties and elongation of the base steel sheet 110 may be reduced.

The additive is a carbide generating element that contributes to the formation of precipitates in the base steel sheet 110. In detail, the additive may include at least one selected from titanium (Ti), niobium (Nb), and vanadium (V).

Titanium (Ti) forms precipitates such as TiC and/or TiN at a high temperature, thereby effectively contributing to austenite grain refinement. Such titanium may be included in 0.018 wt % or greater based on the total weight of the base steel sheet 110. When titanium is included in the above content range, it is possible to prevent poor performance and coarsening of precipitates, to easily secure the physical properties of the base steel sheet 110, and to prevent defects such as cracks on the surface of the base steel sheet 110.

Niobium (Nb) and vanadium (V) may increase strength and toughness depending on a decrease in martensite packet size. Each of niobium and vanadium may be included in 0.015 wt % or greater based on the total weight of the base steel sheet 110. When niobium and vanadium are included in the above range, the crystal grain refinement effect of the base steel sheet 110 is excellent in the hot rolling and cold rolling processes, and during steel making/casting, it is possible to prevent cracks in the slab and brittle fracture of the product, and to minimize the generation of coarse precipitates in steelmaking.

Calcium (Ca) may be added to control the inclusion shape. Such calcium may be included in an amount of 0.003 wt % or less based on the total weight of the base steel sheet 110.

The base steel sheet 110 is formed of a composite structure of a martensite phase having an area fraction of 80% or greater and a bainite phase having an area fraction of less than 20%, thereby having a tensile strength of 1350 MPa or greater and a yield strength of 900 MPa or greater.

The martensitic phase is the result of non-diffusion transformation of austenite y below the initiation temperature (Ms) of martensitic transformation during cooling. Martensite may have a rod-shaped lath phase oriented in one direction (d) in each initial grain of austenite.

In addition, iron-based carbide may be generated inside the martensite phase during the manufacturing process of the plated steel sheet to be described later. The iron-based carbide may be acicular, and the acicular iron-based carbide may have a diameter of less than 0.2 μm and a length of less than 10 Here, the diameter of the acicular iron-based carbide may mean a minor axis length of the iron-based carbide, and the length of the acicular iron-based carbide may mean a major axis length of the iron-based carbide.

When the diameter of the iron-based carbide is 0.2 μm or greater or the length is 10 μm or greater, it remains without melting even at a temperature of Ac3 or higher during the annealing heat treatment process, and thus the bendability and yield ratio of the base steel sheet 110 may be reduced. On the other hand, when the diameter of the iron-based carbide is less than 0.2 μm and the length is less than 10 the balance between strength and formability of the base steel sheet 110 may be improved.

Such iron-based carbide may have an area fraction of less than 5% based on the martensite phase. When the area fraction of the iron-based carbide is 5% or greater based on the martensite phase, it may be difficult to secure the strength or bendability of the base steel sheet 110.

In addition, among the iron-based carbides, the area fraction of the iron-based carbide C1 horizontal to the longitudinal direction d of the lath phase is formed to be larger than the area fraction of the iron-based carbide C2 perpendicular to the longitudinal direction d of the lath phase, so that the bendability of the base steel sheet 110 may be improved. Here, the 'horizontal' may include forming an angle of 20° or less with the longitudinal direction d of the lath phase, and the 'vertical' may include forming an angle of 70° or greater and 90° or less with the longitudinal direction d of the lath phase. In detail, the area fraction of the iron-based carbide C1 forming an angle of 20° or less with the longitudinal direction d of the lath phase may be 50% or greater, preferably 60% or greater, and the area fraction of iron-based carbide C2 forming an angle of 70° or greater and 90° or less with the longitudinal direction d of the lath phase may be less than 50%, preferably less than 40%.

Cracks generated during bending deformation may be generated as dislocations move in the martensite phase. In this case, it may be understood that as the local strain rate among the given plastic deformations has a large value, the energy absorption degree for the plastic deformation of martensite increases, and thus the collision performance increases.

On the other hand, when the area fraction of the iron-based carbide C1 horizontal to the longitudinal direction d of the lath phase is greater than the area fraction of the iron-based carbide C2 perpendicular to the longitudinal direction d of the lath phase, dynamic strain aging (DSA) due to the local strain rate difference in the process of dislocation movement inside the lath during bending deformation. That is, indentation dynamic strain aging may appear. The indentation dynamic strain aging is conceptually a plastic deformation absorption energy, meaning resistance to deformation. Therefore, the more frequent the indentation dynamic deformation aging phenomenon, the better the resistance performance against deformation may be evaluated.

That is, according to the present invention, as the area fraction of the iron-based carbide C1 forming an angle of 20° or less with the longitudinal direction d of the lath phase is formed to be 50% or greater and the area fraction of the iron-based carbide forming an angle between 70° and 90° with the longitudinal direction d of the lath phase is formed to be less than 50%, the indentation dynamic deformation aging phenomenon may occur frequently, and through this, the V-bending angle may be secured at 50° or greater, thereby improving the bendability and collision performance.

Because the bainite phase having an area fraction of less than 20% in the base steel sheet 110 has a uniform hardness distribution, it has an excellent balance between strength and ductility. However, because bainite is softer than martensite, in order to secure the strength and bending properties of the base steel sheet 110, it is preferable that the bainite has an area fraction of less than 20%.

On the other hand, the acicular iron-based carbide described above may also be precipitated inside the bainite phase. Because the iron-based carbide in the bainite increases the strength of bainite and reduces the difference in strength between bainite and martensite, the yield ratio and bendability of the base steel sheet 110 may be increased. In this case, the iron-based carbide may be present in an amount of less than 20% in the bainite phase based on the bainite phase. When the iron-based carbide is 20% or greater based on the bainite phase, voids may be generated, which may lead to a decrease in bendability.

The plating layer 120 may be formed with an adhesion amount of 20 g/m$^2$ to100 g/m$^2$ based on one side. For example, a precoat layer is formed when the base steel sheet 110 is immersed in the plating bath containing at least one of molten aluminum and aluminum alloy at a temperature of 600° C. to 800° C. and then cooled at an average cooling rate of 1° C./s to 50° C./s. Then, in the process of hot stamping the base steel sheet 110 on which the precoat layer is formed, the plating layer 120 may be formed through alloying by mutual diffusion between the base steel sheet 110 and the precoat layer.

In addition, after the base steel sheet 110 is immersed in the plating bath, one or more of air and gas is sprayed on the surface of the base steel sheet 110 to wipe the hot-dip plated layer, and by controlling the spray pressure, the plating adhesion amount of the precoat layer may be adjusted.

The precoat layer is formed on the surface of the base steel sheet 110, is formed between the surface layer and the surface layer and the base steel sheet 110 containing 80% by weight or greater of aluminum (Al), and may include an alloying layer including an aluminum-iron (Al—Fe) and an aluminum-iron-silicon (Al—Fe—Si) intermetallic compound. The alloying layer may include 20 wt % to 70 wt % of iron (Fe). As an example, the surface layer may contain 80 wt % to 100 wt % of aluminum and may have an average thickness of 10 μm to 40 μm.

On the other hand, when the base steel sheet 110 with the precoat layer is heated in a heating furnace to perform hot stamping for press-forming the base steel sheet 110 with the precoat layer at a high temperature, mutual diffusion occurs between the base steel sheet 110 and the precoat layer during the heating process, and the precoat layer is alloyed to form the plating layer 120.

On the other hand, in the process of forming the plating layer 120, hydrogen may be introduced into the base steel sheet 110 from the heating furnace, and hydrogen delayed destruction may be induced in the base steel sheet 110 by hydrogen introduced into the base steel sheet 110. However, according to the present invention, at least some of the alloying elements included as additives exist as precipitates in the base steel sheet 110, and these precipitates capture hydrogen distributed in the base steel sheet 110, thereby improving the hydrogen-delayed fracture resistance. The precipitate may include a carbide of at least one of titanium (Ti), niobium (Nb), and vanadium (V).

In the meantime, the member 100 for an automobile structure according to the present invention may include at least one bent portion C depending on the applied position. The bent portion C is a portion that is excessively formed compared to a flat area, and stress is relatively concentrated during press molding. By using this concentrated stress as a driving force, a partial change in the behavior of the precipitate may occur, and the residual stress may be relatively large. In this case, the bent portion C may be a weak point of hydrogen delayed destruction. Therefore, it is necessary to improve the hydrogen trapping ability of the precipitate to prevent the hydrogen delayed destruction from occurring even if the member 100 for an automobile structure includes a bent portion. To do this, by allowing the precipitate to form a semi-coherent interface with iron of the base steel sheet 110, the hydrogen trapping ability of the precipitate may be improved.

Figure 4:
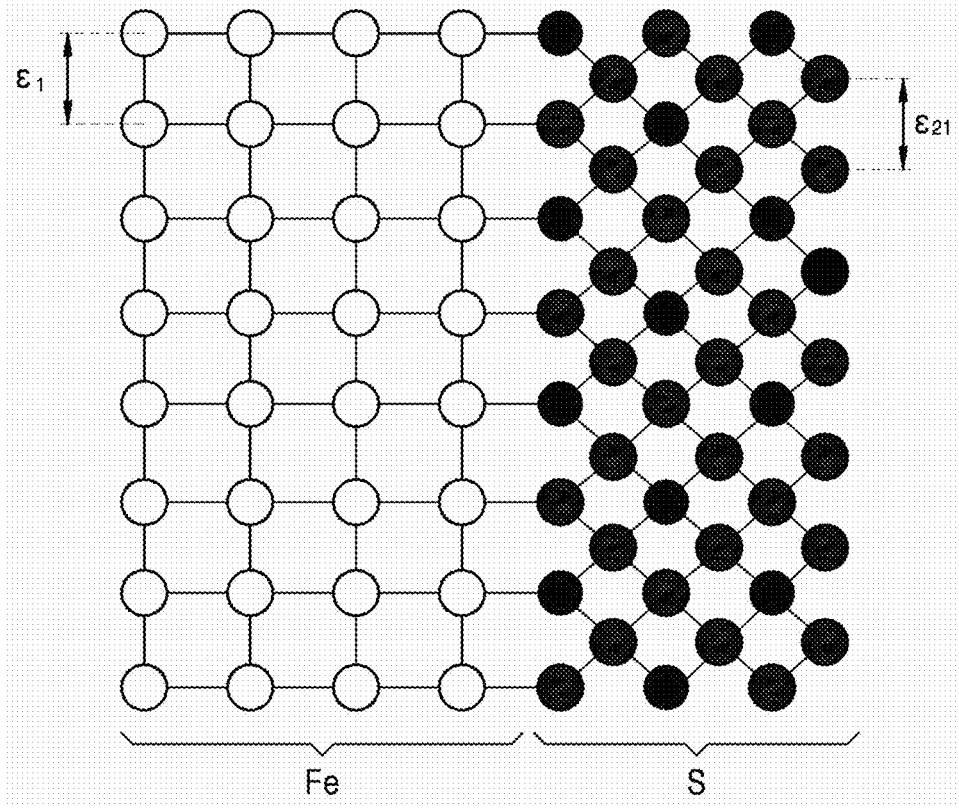
FIGS. 4 to 6 show cross-sectional views schematically illustrating an interface between iron and precipitates of a base steel sheet, respectively.
Figure 5:
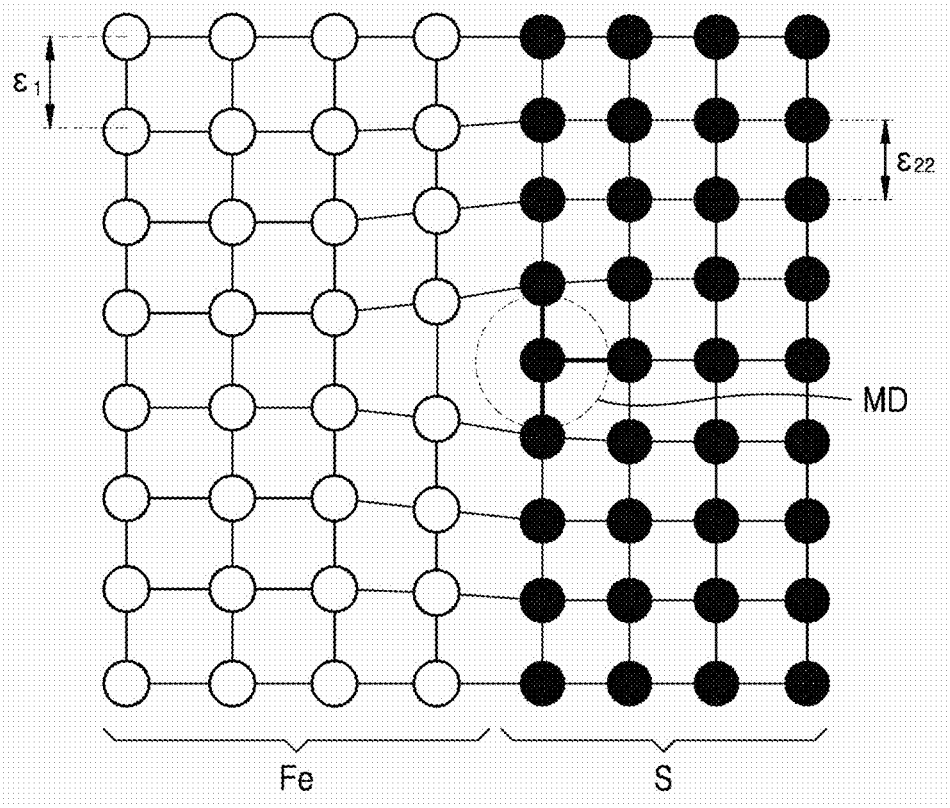
Figure 6:
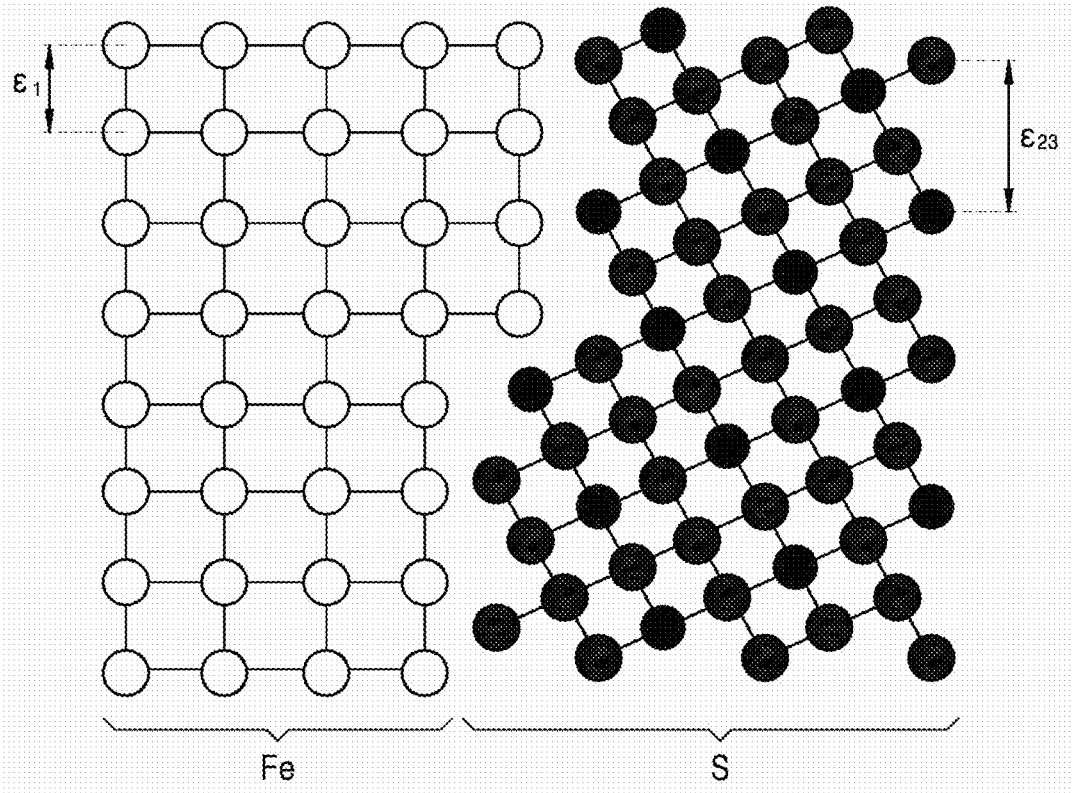
Figure 7:
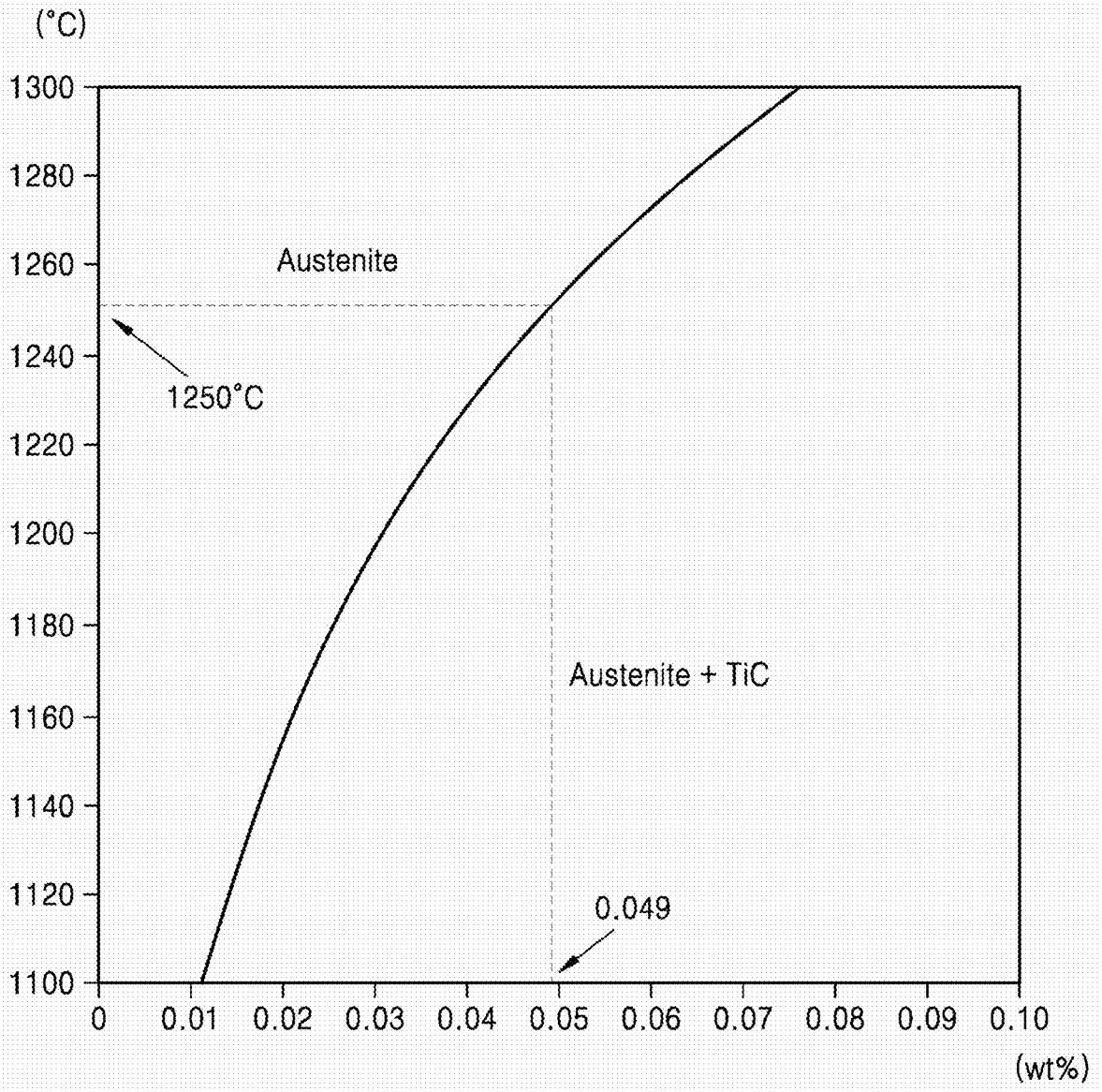
FIGS. 7 to 9 show state diagrams showing the solubility of precipitates, respectively.
Figure 8:
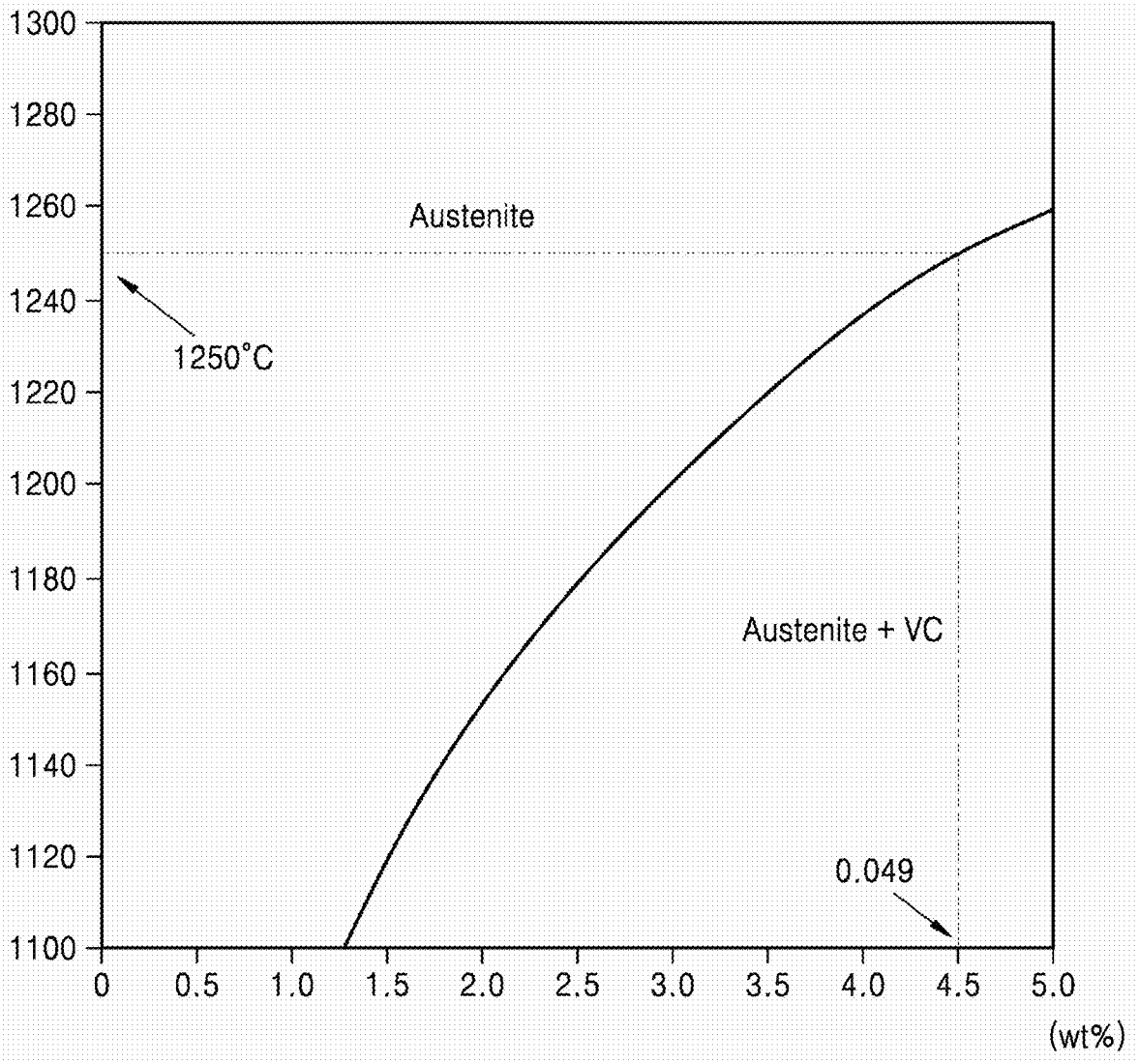
Figure 9:
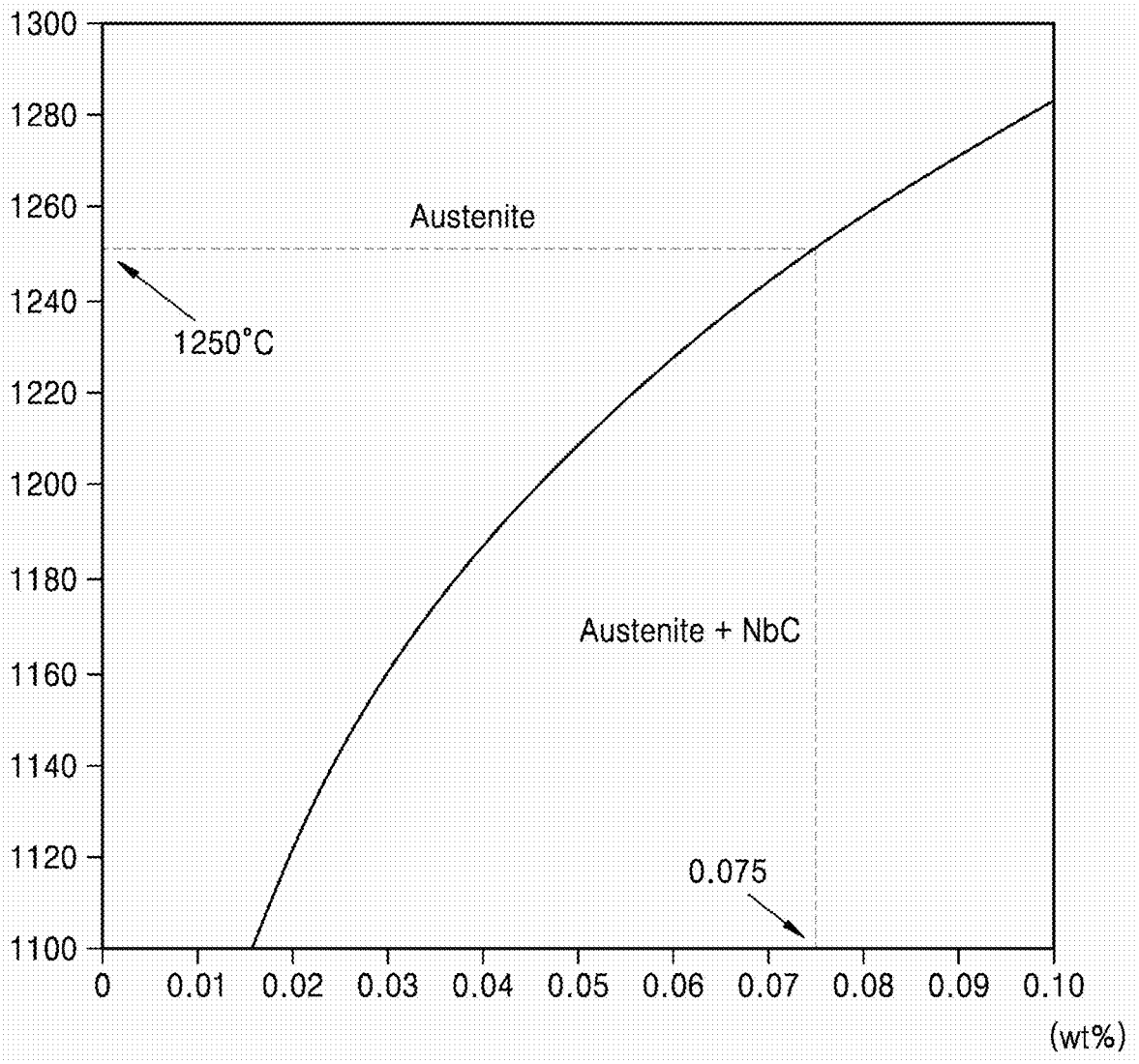

FIGS. 4 to 6 show cross-sectional views schematically illustrating an interface between iron and precipitates of a base steel sheet, respectively, and FIGS. 7 to 9 show state diagrams showing the solubility of precipitates, respectively.

First, FIG. 4 shows a state in which iron (Fe) and the precipitate (S) of the base steel sheet form a coherent interface with each other, FIG. 5 shows a state in which iron (Fe) and precipitates (S) of the base steel sheet form a semi-coherent interface with each other, and FIG. 6 shows a state in which iron (Fe) and precipitates (S) of the base steel sheet form an inconsistent interface with each other.

As shown in FIG. 4, in order to form a coherent interface between iron (Fe) and precipitate (S) of the base steel sheet, the lattice constant $\varepsilon_1$ of iron (Fe) must match the lattice constant $\varepsilon_{21}$ of the precipitate (S), and as shown in FIG. 6, in order to form an incoherent interface between iron (Fe) and precipitates (S) of the base steel sheet, the absolute value of the difference between the lattice constant $\varepsilon_1$ of iron (Fe) of the base steel and the lattice constant $\varepsilon_{23}$ of the precipitate (S) must be 25% or greater of the lattice constant $\varepsilon_1$ of iron (Fe). That is, as shown in FIG. 5, when the absolute value of the difference between the lattice constant $\varepsilon_1$ of iron (Fe) of the base steel sheet and the lattice constant $\varepsilon_{22}$ of the precipitate (S) is less than 25% of the lattice constant $\varepsilon_1$ of iron (Fe), the iron of the base steel sheet (Fe) may form a semi-coherent interface with the precipitate (S). For example, the lattice constant value of the precipitate S may be smaller than the lattice constant $\varepsilon_1$ of iron and greater than 0.75 times the lattice constant $\varepsilon_1$ of iron.

On the other hand, when the iron (Fe) and the precipitate (S) of the base steel sheet form a semi-coherent interface, a mismatch dislocation MD exists at the boundary between iron (Fe) and precipitate (S), the number of sites capable of capturing hydrogen increases compared to the case of forming a coherent interface and an incoherent interface by such a mismatch dislocation MD, and the bond energy with hydrogen increases. In detail, at the coherent interface, semi-coherent interface, and incoherent interface, the binding energies with hydrogen were measured to be 0.813 eV, 0.863 eV, and 0.284 eV, respectively. Therefore, the case where iron (Fe) and the precipitate (S) of the base steel sheet form a semi-coherent interface is better than the case where the iron (Fe) and the precipitate (S) form a coherent interface and an incoherent interface in the effect of capturing hydrogen.

On the other hand, in order to form a semi-coherent interface between the iron (Fe) and the precipitate of the base steel sheet, the precipitate(S) may form an interface with iron (Fe), the interface having a relationship (Baker-Nutting (BN) orientation) of $(001)_{Fe}\|(001)_{precipitate}$ and $[100]_{precipitate}\|[110]_{Fe}$. In this case, as the size of the precipitates increases, the interface state formed between iron and precipitates may change from a conformational interface to a semiconsistent interface. It can be determined by Equation (2).

$$P = \left|\frac{a_{(S)}a_{(Fe)}}{a_{(S)} - a_{(Fe)}}\right| \quad \text{[Equation 1]}$$

$$P = Aa_{(S)} = (A+1)a_{(Fe)} \quad \text{[Equation 2]}$$

In Equations 1 and 2, p is the minimum periodicity at which mismatch dislocations (MD) may be formed, $a_{(s)}$ is the BN orientation lattice constant of the precipitate, and $a_{(Fe)}$ is the BN orientation lattice of iron.

Table 1 below shows the minimum sizes of carbides of titanium (Ti), niobium (Nb) and vanadium (V) for forming a semi-coherent interface with iron, determined by Equations 1 and 2, respectively.

TABLE 1

| | BN orientation | BN orientation Lattice constant (Å) | periodicity, p (Å) |
|---|---|---|---|
| Fe | [110](001) | 4.630 | |
| TiC | [100](001) | 4.336 | 68 |
| NbC | [100](001) | 4.507 | 169 |
| VC | [100](001) | 4.160 | 41 |

In Table 1, it may be seen that among the precipitates, when TiC has a periodicity of 6.8 nm or greater, NbC is 16.9 nm or greater, and VC is 4.1 nm or greater, that is, TiC is 6.8 nm or greater, NbC is 16.9 nm or greater, and VC has a size of 4.1 nm or greater, it forms a semi-coherent interface with Fe. Therefore, as TiC has a size of 6.8 nm or greater, NbC is 16.9 nm or greater, and VC is formed with a size of 4.1 nm or greater, a mismatch dislocation MD may exist at the boundary between iron (Fe) and the precipitate (S), and the ability to capture hydrogen may be improved. On the other hand, in order for the precipitates to have the above size, the precipitation behavior of the precipitates may be controlled by adjusting the manufacturing process conditions of the base steel sheet. For example, by adjusting the coiling temperature (CT) range of the process conditions, it is possible to control the precipitation behavior such as the number of precipitates and the diameter of the precipitates. The above will be described later. On the other hand, when the content of the alloying element forming the precipitate is greater than the solubility in iron, the precipitate is precipitated in a state in which it is not dissolved in iron, and the iron forms an incoherent interface with the precipitate. As described above, in the case where iron forms an incoherent interface with the precipitate, the binding energy between the precipitate and hydrogen is formed less than that in the case where iron forms a coherent or semi-coherent interface with the precipitate, so that the hydrogen capture ability may be reduced. In addition, the bent portion C of the member 100 for an automobile structure has a relatively large residual stress. As a result, activated hydrogen that is not captured together with the residual stress of the bent portion C of the member 100 for an automobile structure has an effect, thereby increasing the possibility that delayed hydrogen destruction occurs in the bent portion C of the member 10 for an automobile structure.

Accordingly, the additive may be included within the range of solubility for iron. In detail, titanium (Ti), niobium (Nb) and vanadium (V) may be included in a range that may be dissolved in austenite, and as a result, precipitates that are carbides of titanium (Ti), niobium (Nb), and vanadium (V) may be dissolved in iron of the base steel sheet 110.

For example, as shown in each of FIGS. 7 to 9, based on the slab reheating temperature (1250° C.) during the manufacturing process of the base steel sheet 110, titanium (Ti) may be included in less than 0.049 wt %, vanadium (V) in less than 4.5 wt %, and niobium (Nb) in less than 0.075 wt %, based on the total weight of the base steel sheet 110. Therefore, based on 1250° C., titanium (Ti) may be included in 0.018 wt % or greater and less than 0.049 wt % based on the total weight of the base steel sheet, vanadium (V) may be included in 0.015 wt % or greater and less than 4.5 wt % based on the total weight of the base steel sheet, and niobium (Nb) may be included in an amount of 0.015 wt % or greater and less than 0.075 wt % based on the total weight of the base steel sheet, so that their precipitates may have a state of solid-solution in the martensitic structure of the base steel sheet.

On the other hand, when the precipitates are solid dissolved in iron, the size of the precipitates is controlled by CT range during the manufacturing process of the base steel sheet 110, so that the precipitate may form a semi-coherent interface with iron, and by allowing the precipitate to form a mismatch dislocation at the interface with iron, the effect of hydrogen trapping by the precipitate may be further improved. For example, that is, the lattice constant value of the precipitates S may be less than the lattice constant of iron, and may be greater than 0.75 times the lattice constant of iron, and greater than 90% of the precipitates present in the bent portion (C of FIG. 1) may have the lattice constant value. Therefore, even if the member 100 for an automobile structure includes a bent portion having a large internal stress, it is possible to prevent delayed hydrogen destruction from occurring in the bent portion.

Figure 10:
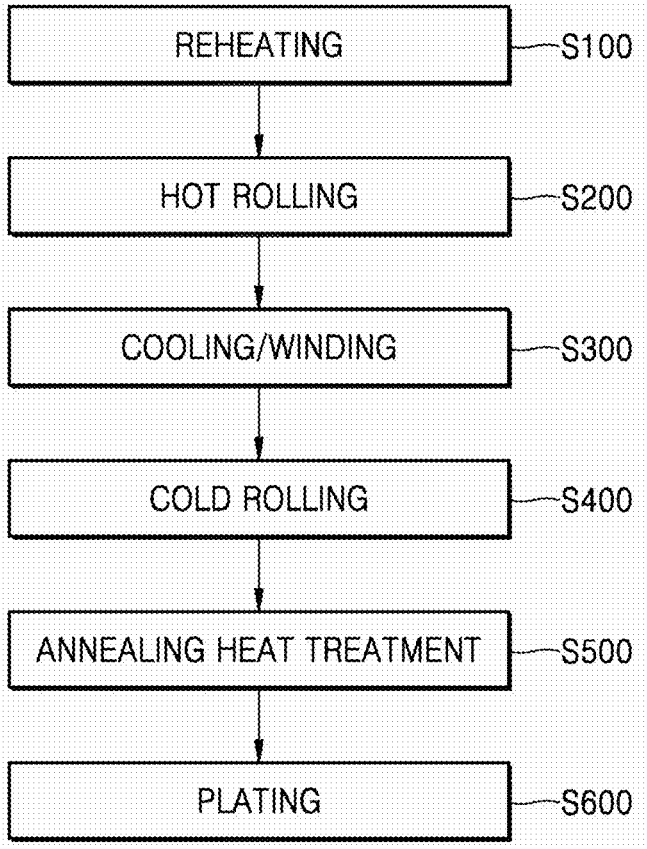
FIG. 10 shows a flowchart schematically illustrating an example of a method of manufacturing a member for an automobile structure of FIG. 1.

FIG. 10 shows a flowchart schematically illustrating an example of a method of manufacturing a member for an automobile structure of FIG. 1.

As shown in FIG. 10, the method for manufacturing a member for an automobile structure according to an embodiment of the present invention may include a reheating operation (S100), a hot rolling operation (S200), a cooling/winding operation (S300), a cold rolling operation (S400), an annealing heat treatment operation (S500), and a plating operation (S600). On the other hand, in FIG. 10, operations S100 to S600 are illustrated as independent operations, but some of operations S100 to S600 may be performed in one process, and some may be omitted if necessary.

First, a slab in a semi-finished state to be subjected to a process of forming a base steel sheet is prepared. The slab may include an amount of 0.19 wt % to 0.38 wt % of carbon (C), an amount of 0.5 wt % to 2.0 wt % of manganese (Mn), an amount of 0.001 wt % to 0.005 wt % of boron (B), an amount of 0.03 wt % or less of phosphorus (P), an amount of 0.003 wt % or less of sulfur (S), an amount of 0.1 wt % to 0.6 wt % of silicon (Si), an amount of 0.1 wt % to 0.6 wt % of chromium (Cr), and the balance of iron (Fe) and unavoidable impurities based on the total weight of the base steel sheet. In addition, the slab may include at least one of titanium (Ti), niobium (Nb), and vanadium (V).

The reheating operation (S100) is an operation of reheating the slab for hot rolling. In the reheating operation (S100), the segregated components are re-solid-dissolved during casting by reheating the slab secured through the continuous casting process in a predetermined temperature range.

The slab reheating temperature (SRT) may be controlled within a preset temperature range to maximize the austenite refining and precipitation hardening effects. In this case, an SRT range may be included in a temperature range (about 1,000° C. or higher) at which the additives (Ti, Nb, and/or V) are fully solid-dissolved during reheating of the slab. When the SRT is less than a fully solid-solution temperature range of the additives (Ti, Nb and/or V), the driving force required for microstructure control during hot rolling is not sufficiently reflected, so that the effect of securing excellent mechanical properties through the required precipitation control may not be obtained.

In an exemplary embodiment, the SRT may be controlled to a temperature of 1,200° C. to 1,300° C. When the SRT is less than 1,200° C., there is a problem in that it is difficult to see the effect of homogenizing the alloying elements largely because the segregated components are not sufficiently re-solid-dissolved during casting, and it is difficult to see the effect of the solid-solution of titanium (Ti) significantly. On the other hand, the higher the SRT, the more favorable for homogenization, but when it exceeds 1,300° C., the austenite grain size increases, making it difficult to secure strength, and only the manufacturing cost of the steel sheet may increase due to the excessive heating process.

The hot rolling operation S200 is an operation of manufacturing a steel sheet by hot rolling the slab reheated in operation S100*l* in a predetermined finishing delivery temperature (FDT) range. In an exemplary embodiment, the finish rolling temperature (FDT) range may be controlled to a temperature of 840° C. to 920° C. When the FDT is less than 840° C., it is difficult to secure the workability of the steel plate due to the occurrence of a mixed structure due to rolling in an abnormal area, and there is a problem of sheet passage ability during hot rolling due to a sudden phase change, as well as a problem in that workability is deteriorated due to microstructure non-uniformity. Conversely, when the FDT exceeds 920° C., the austenite grains are coarsened. In addition, there is a risk that TiC precipitates are coarsened and the final member performance is deteriorated.

The cooling/winding operation S300 is an operation of cooling and winding the steel sheet hot-rolled in operation S200 within a predetermined CT range, and forming precipitates in the steel sheet. That is, in operation S300, precipitates are formed by forming carbides of additives (Ti, Nb, and/or V) included in the slab. In an exemplary embodiment, the CT may be 700° C. to 780° C. The CT affects the redistribution of carbon (C). When the CT is less than 700° C., the low-temperature phase fraction increases due to overcooling, which may increase strength and increase the rolling load during cold rolling, and there is a problem in that ductility is rapidly lowered. Conversely, when the CT exceeds 780° C., there is a problem in that formability and strength deteriorate due to abnormal crystal grain growth or excessive crystal grain growth.

On the other hand, by controlling the CT range, the precipitation behavior of the precipitates may be controlled. In detail, when the additive is included in the solubility range for iron, by controlling the CT range, the size of the precipitate may be controlled so that the interface between the precipitate and the iron forms a semi-coherent interface.

The cold rolling operation S400 is an operation of cold rolling after uncoiling the steel sheet wound in operation S300 and pickling treatment. In this case, the pickling is performed for the purpose of removing the scale of the wound steel sheet, that is, the hot rolled coil manufactured through the hot rolling process. On the other hand, in an exemplary embodiment, the rolling reduction during cold rolling may be controlled to 30% to 70%, but is not limited thereto.

The annealing heat treatment operation S500 is an operation of annealing the cold-rolled steel sheet in operation S400 at a temperature of 700° C. or higher. In an exemplary embodiment, the annealing heat treatment includes heating the cold-rolled sheet and cooling the heated cold-rolled sheet at a predetermined cooling rate. As an example, after the heated cold-rolled sheet is cooled at an average cooling rate of 5° C./s or greater up to about 300° C., automatic tempering is performed up to about 100° C. to control the size, area fraction and directionality of the iron-based carbide.

The plating operation S600 is an operation of forming a plating layer on the annealed heat-treated steel sheet. In an exemplary embodiment, in the plating operation S600, an Al—Si plating layer may be formed on the steel sheet subjected to the annealing heat treatment in operation S500.

In detail, the plating operation S600 may include an operation of immersing the steel sheet in a plating bath having a temperature of 650° C. to 700° C. to form a hot-dip plating layer on the surface of the steel sheet and a cooling operation of cooling the steel sheet on which the hot-dip plated layer is formed to form a plating layer. In this case, the plating bath may include Si, Fe, Al, Mn, Cr, Mg, Ti, Zn, Sb, Sn, Cu, Ni, Co, In, Bi, etc. as an additive element, but is not limited thereto.

As described above, by performing the hot stamping process on the steel sheet manufactured through the operations S100 to S600, a member for an automobile structure satisfying the required strength and bendability may be manufactured. In an exemplary embodiment, the member for an automobile structure manufactured to satisfy the above-described content conditions and process conditions may have a tensile strength of 1350 MPa or greater and a yield strength of 900 MPa or greater.

Hereinafter, the present invention will be described in more detail through examples and comparative examples. However, the following examples and comparative examples are for explaining the present invention in more detail, and the scope of the present invention is not limited by the following examples and comparative examples. The following examples and comparative examples may be appropriately modified and changed by those skilled in the art within the scope of the present invention.

Figure 11:
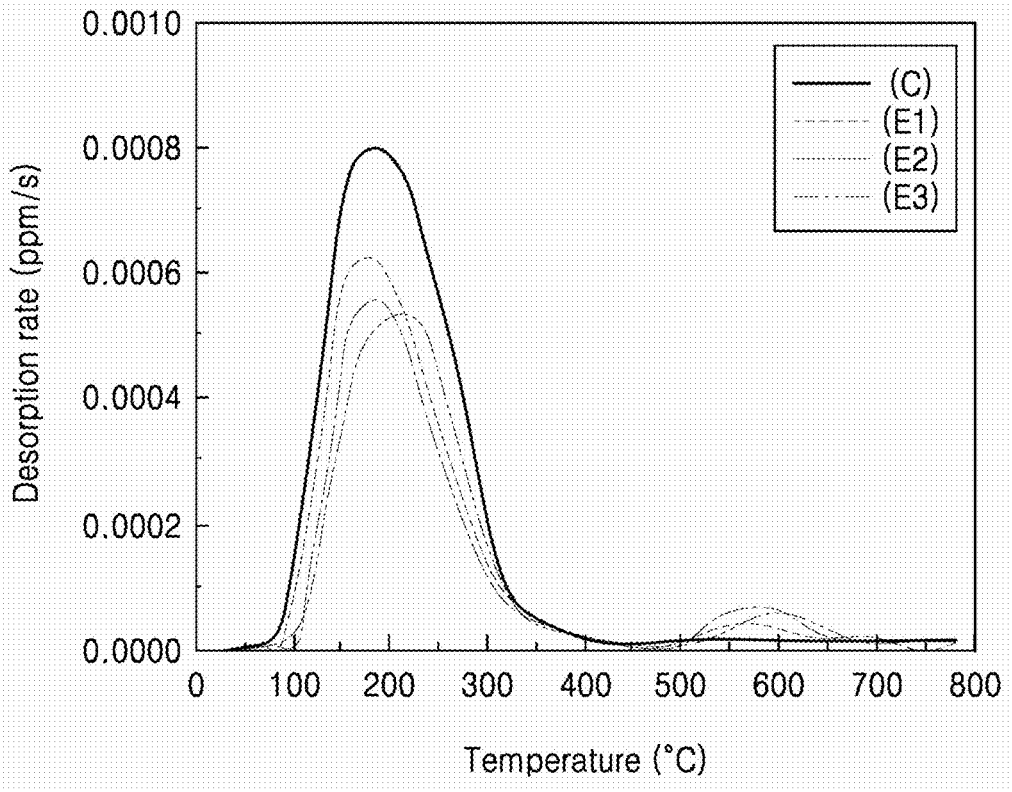
FIG. 11 shows a graph showing the amount of diffusible hydrogen included in a member for an automobile structure according to an exemplary embodiment of the present invention.

FIG. 11 shows a graph showing the amount of diffusible hydrogen contained in a member for an automobile structure. In detail, C in FIG. 11 is a result (comparative example 1) of measuring the amount of diffusible hydrogen in a specimen prepared by hot stamping a plated steel sheet manufactured by performing the above-described steps S100 to S600 for the following slab having the composition shown in Table 2, and E1, E2, and E3 in FIG. 11 are results (example 1, example 2, and example 3) of measuring the amount of diffusible hydrogen in a specimen prepared by the same manufacturing method as in comparative example 1 for the slab having a composition further including niobium (Nb) 0.07 wt %, titanium (Ti) 0.045 wt %, and vanadium (V) 4.0 wt % in the composition of Table 2.

TABLE 2

| C | Mn | B | P | S | Si | Cr |
|---|---|---|---|---|---|---|
| 0.25 | 1.6 | 0.003 | 0.015 | 0.002 | 0.3 | 0.3 |

FIG. 11 shows the results of thermal desorption spectroscopy. The thermal desorption spectroscopy method is to measure the amount of hydrogen emitted from the specimen below a specific temperature while heating the specimen at a preset heating rate to increase the temperature, and hydrogen released from the specimen may be understood as activated hydrogen that is not captured among hydrogen introduced into the specimen and affects delayed hydrogen destruction. That is, when the amount of hydrogen measured as a result of thermal desorption spectroscopy is large, it means that a large amount of activated hydrogen that may cause delayed destruction of uncaptured hydrogen is included.

FIG. 11 shows the measured values of the amount of hydrogen emitted from each specimen while raising the temperature from room temperature to 800° C. at a heating rate of 20° C./min for each of the specimens. In FIG. 11, comparative example 1 C has a measured activated hydrogen of 0.95 wppm, example 2 E2 has a measured activated hydrogen was 0.55 wppm, example 3 E3 has a measured activated hydrogen of 0.51 wppm, and it may be seen that the amount of hydrogen measured in examples 1 E1, example 2 E2, and example 3 E3 was reduced compared to comparative Example 1 C. This shows that compared to comparative example 1 C, example 1 E1 includes niobium (Nb), example 2 E2 includes titanium (Ti), and example 3 E3 further includes vanadium (V), and as a result, these added alloying elements form carbides, thereby capturing hydrogen.

Table 3 below shows the measured amount of activated hydrogen and the 4-point bending test results of the specimens depending on the size of the precipitates of examples 1 to 3 and comparative examples 2 to 4. Here, the size of the precipitates means the average size of the precipitates present in a unit area (100 $\mu m^2$), and the amount of active hydrogen was measured in the same manner as in FIG. 10.

In addition, the 4-point bending test is a test method to check whether stress corrosion cracking occurs by applying a stress below the elastic limit to a specific point on the specimen prepared by reproducing the state of exposing the specimen to a corrosive environment. In this case, stress corrosion cracking refers to cracks that occur when corrosion and continuous tensile stress act simultaneously. In detail, the results of the 4-point bending test in Table 3 are results of confirming whether fracture occurs by applying a stress of 1,000 MPa in air for 100 hours to each of the specimens.

Examples 1 to 3 are the same as examples 1 to 3 in Table 2, and comparative examples 2 to 4 are specimens prepared from slabs having the same composition as examples 1 to 3, respectively, or specimens prepared by differentially applying only the CT as a variable. In detail, examples 1 to 3 are specimens prepared by hot stamping a plated steel sheet prepared by applying the CT of 700° C., and comparative examples 2 to 4 are specimens prepared by hot stamping a plated steel sheet prepared by applying the CT of 600° C.

TABLE 3

| | Size of precipitate (nm) | Amount of activated hydrogen (wppm) | 4 point bending test result |
|---|---|---|---|
| Example 1 | 16.9 (NbC) | 0.61 | Non-fractured |
| Example 2 | 6.8 (TiC) | 0.55 | Non-fractured |
| Example 3 | 4.1 (VC) | 0.51 | Non-fractured |
| Comparative Example 2 | 15 (NbC) | 0.78 | Fractured |
| Comparative Example 3 | 5.5 (TiC) | 0.75 | Fractured |
| Comparative Example 4 | 3.2 (VC) | 0.76 | Fractured |

As shown in Table 3 above, in comparative examples 2 to 4, it may be seen that the measured amount of activated hydrogen is larger than that of examples 1 to 3, respectively. It may be understood that the size of the precipitate is not large enough to form a semi-coherent interface at the interface with iron, even if the additive is included in the solubility with respect to iron, so that the mismatch dislocation is not sufficiently formed at the interface between the precipitate and the iron. As a result, it may be seen that even if a precipitate that traps hydrogen is formed, the hydrogen trapping ability is not sufficient and the result of the 4-point bending test indicates 'fractured'. That is, examples 1 to 3, in which the amount of activated hydrogen is relatively lower, indicate 'non-fractured', and thus it may be understood that the delayed hydrogen fracture characteristics are improved. Table 4 below shows the measured amount of activated hydrogen and the 4-point bending test results of the specimens depending on the content of alloying elements of examples 1 to 3 and comparative examples 5 to 10. Examples 1 to 3 and comparative examples 5 to 10 are specimens prepared by hot stamping a plated steel sheet manufactured by the same manufacturing method. In Table 4, the amount of active hydrogen was measured in the same method as in FIG. 11, and the 4-point bending test was performed in the same method as in Table 3.

TABLE 4

| | Content of alloying elements (wt %) | Amount of activated hydrogen (wppm) | 4 point bending test result |
|---|---|---|---|
| Example 1 | 0.07 (Nb) | 0.61 | Non-fractured |
| Example 2 | 0.045 (Ti) | 0.55 | Non-fractured |
| Example 3 | 4.0 (V) | 0.51 | Non-fractured |
| Comparative Example 5 | 0.15 (Nb) | 0.91 | Fractured |
| Comparative Example 6 | 0.1 (Ti) | 0.89 | Fractured |
| Comparative Example 7 | 6.0 (V) | 0.93 | Fractured |
| Comparative | 0.02 (Nb) | 0.73 | Fractured |

TABLE 4-continued

| | Content of alloying elements (wt %) | Amount of activated hydrogen (wppm) | 4 point bending test result |
|---|---|---|---|
| Example 8 | | | |
| Comparative Example 9 | 0.01 (Ti) | 0.70 | Fractured |
| Comparative Example 10 | 0.02 (V) | 0.71 | Fractured |

Comparative examples 5 to 7 were cases in which the content of the additive exceeded the solubility with respect to iron, and the measured amount of activated hydrogen was greater than that of examples 1 to 3, respectively, and a result of the 4-point bending test indicates 'fractured'. This is because the additive is not fully solid-dissolved during reheating of the slab, and the precipitates are coarsened and form an incoherent interface with iron, which reduces the hydrogen trapping ability of the precipitates. On the other hand, in comparative examples 8 to 10, as a result of a low amount of addition, precipitates capable of capturing hydrogen were not sufficiently formed, and brittle fracture occurred. On the other hand, in examples 1 to 3, the alloying element is contained within the solubility range with respect to iron, and a semi-coherent interface is formed at the interface between the precipitate and iron, so that the result of the 4-point bending test indicates 'non-fractured'. Thus, it may be understood that the hydrogen delayed fracture characteristics are improved.

Table 5 below shows the results of measuring the V-bending angles of examples 1 to 3 and comparative examples 11 to 13. 'V-bending' is a parameter that evaluates the bending deformation properties in the maximum load sections among deformations in the bending performance. That is, looking at the tensile deformation region during bending in macroscopic and microscopic sizes according to the load-displacement evaluation of the specimen, when microcracks are generated and propagated in the local tensile region, the bending performance called V-bending angle may be evaluated.

In Table 5, comparative examples 11 to 13 are specimens prepared in the same manner as in examples 1 to 3, respectively, but only when auto-tempering is not performed from 300° C. to 100° C. in the annealing heat treatment operation. In the case of the following specimens, by observing the microstructure at ¼ of the thickness of the specimen from the surface of the specimen, the average size and area fraction of acicular carbides in martensite and the area fraction of acicular carbides having an angle of 20° or less with the longitudinal direction of the lath phase were measured.

TABLE 5

| | Carbide Average Diameter (μm) | Carbide Average Length (μm) | Carbide Area Fraction (%) | Area fraction of acicular carbide of which angle with the longitudinal direction of the lath phase is 20° or less (%) | V-bending (°) |
|---|---|---|---|---|---|
| Example 1 | 0.17 | 7.3 | 4.5 | 57 | 50 |
| Example 2 | 0.15 | 8.2 | 4.6 | 62 | 51 |
| Example 3 | 0.12 | 8.5 | 4.8 | 59 | 53 |
| Comparative Example 11 | 0.17 | 5.0 | 5.2 | 45 | 44 |
| Comparative Example 12 | 0.14 | 4.4 | 4.9 | 44 | 42 |
| Comparative Example 13 | 0.13 | 5.3 | 5.3 | 48 | 44 |

As shown in Table 5 above, in the case of examples 1 to 3 in which auto-tempering was performed from 300° C. to 100° C. in the manufacturing process of the plated steel sheet, acicular iron-based carbide in martensite has an area fraction of less than 5% based on the martensite phase, has a size of less than 0.2 μm in diameter and less than 10 μm in length, and the area fraction of the acicular carbide having an angle of 20° or less with the longitudinal direction of the lath phase is formed to be 50% or greater. Through these things, it may be seen that the V-bending angle may be secured greater than 50°, so it may be confirmed that the tensile strength and bendability are improved. In contrast, in comparative examples 11 to 13, the iron-based carbide was formed to have a relatively small size, but it may be seen that greater iron-based carbides are formed in a direction perpendicular to the longitudinal direction of the lath phase, so that the bendability of the plated steel sheet is reduced compared to examples 1 to 3. That is, it may be confirmed that the area fraction of the acicular carbide having an angle of 20° or less with the longitudinal direction of the lath phase is 50% or greater, thereby improving tensile strength and bendability.

As such, the present invention has been described with reference to exemplary embodiments shown in the drawings, but this is merely exemplary, and those skilled in the art will understand that various modifications and variations of the embodiments are possible therefrom. Accordingly, the true technical protection scope of the present invention should be determined by the technical idea of the appended claims.

The invention claimed is:

1. A member for automobile structure, comprising:

a base steel sheet, and a plating layer covering at least one surface of the base steel sheet, wherein the base steel sheet comprises an amount of 0.19 wt % to 0.38 wt % of carbon (C), an amount of 0.5 wt % to 2.0 wt % of manganese (Mn), an amount of 0.001 wt % to 0.005 wt % of boron (B), an amount of 0.03 wt % or less of phosphorus (P), an amount of 0.003 wt % or less of sulfur(S), an amount of 0.1 wt % to 0.6 wt % of silicon (Si), an amount of 0.1 wt % to 0.6 wt % of chromium (Cr), with the balance being iron (Fe) and unavoidable impurities, based on the total weight of the base steel sheet, wherein the base steel sheet further comprises at least one element selected from the group consisting of 0.018 wt % or greater and less than 0.049 wt % of titanium (11), 0.015 wt % or greater and less than 0.075 wt % of niobium (Nb), and 0.015 wt % or greater and less than 4.5 wt % of vanadium (V), wherein the member for automobile structure has a tensile strength of 1350 MPa or greater and a yield strength of 900 MPa or greater, wherein the base steel sheet comprises:

a martensite phase having an area fraction of 80% or greater;

an iron-based carbide located inside the martensite phase and having an area fraction of less than 5% based on the martensite phase; and precipitates distributed inside the base steel sheet, and wherein a mismatch dislocation exists at interface between iron and the precipitates of the base steel sheet, and a difference between lattice constants of the iron and the precipitates is less than 25% of the lattice constants of the iron.

2. The member for automobile structure of claim 1, wherein the iron-based carbide is acicular with a diameter of less than 0.2 μm and a length of less than 10 μm.

3. The member for automobile structure of claim 1, wherein the interface between the precipitates and the iron has a relationship of:

$$(001)_{Fe}\|(001)_{precipitate} \text{ and } [100]_{precipitate}\|[110]_{Fe}.$$

4. The member for automobile structure of claim 1, wherein the precipitates comprise at least one carbide of titanium (Ti), niobium (Nb), and vanadium (V), and trap hydrogen.

5. The member for automobile structure of claim 1, wherein the plating layer comprises aluminum (Al).

6. The member for automobile structure of claim 2, wherein the martensite comprises a lath phase, and among the iron-based carbides, an area fraction of iron-based carbides horizontal to a longitudinal direction of the lath phase is greater than an area fraction of iron-based carbides perpendicular to the longitudinal direction of the lath phase.

7. The member for automobile structure of claim 2, wherein the martensite comprises a lath phase, and among the iron-based carbides, an area fraction of the iron-based carbides forming an angle of 20° or less with a longitudinal direction of the lath phase is 50% or greater.

8. The member for automobile structure of claim 2, wherein the martensite comprises a lath phase, and among the iron-based carbides, an area fraction of iron-based carbides forming an angle of 70° or greater and 90° or less with a longitudinal direction of the lath phase is less than 50%.

9. The member for automobile structure of claim 4, wherein, among the at least one carbide, TiC has a size of 6.8 nm or greater, NbC has a size of 16.9 nm or greater, and VC has a size of 4.1 nm or greater.

* * * * *